United States Patent [19]

Drechsel

[11] Patent Number: 4,842,199

[45] Date of Patent: Jun. 27, 1989

[54] SELF-ADJUSTING ROTARY-ARM IRRIGATION SPRINKLER

[76] Inventor: Arno Drechsel, Via Castel Mareccio, 4, 39100 Bolzano, Italy

[21] Appl. No.: 197,150

[22] Filed: May 23, 1988

[30] Foreign Application Priority Data

Jun. 11, 1987 [IT] Italy ..... 46854 A/87

[51] Int. Cl.[4] ..... B05B 3/02; B05B 3/14

[52] U.S. Cl. ..... 239/230; 239/233; 239/503; 239/510; 239/515

[58] Field of Search ..... 239/230–233, 239/503, 507, 510, 514, 515, 251, 252

[56] References Cited

U.S. PATENT DOCUMENTS 3,559,887 2/1971 Meyer ..... 239/233
4,342,424 8/1982 Meyer et al. ..... 239/233
4,449,668 5/1984 Drechsel ..... 239/233 X
4,531,674 7/1985 Drechsel ..... 239/230
4,637,549 1/1987 Schwartzman ..... 239/230

FOREIGN PATENT DOCUMENTS 500789 11/1954 Italy ..... 239/230

*Primary Examiner*—Andres Kashnikow
*Assistant Examiner*—Patrick N. Burkhart
*Attorney, Agent, or Firm*—Birch, Stewart, Kolasch & Birch

[57] ABSTRACT

A self-adjusting rotary-arm irrigation sprinkler comprises an intermediate piece (8) between the propulsion tube (1) and rotary arm (13), which supports the rotary arm and the position of which is adjustable in height relative to the propulsion tube by means connected to the propulsion tube.

12 Claims, 4 Drawing Sheets

SELF-ADJUSTING ROTARY-ARM IRRIGATION SPRINKLER

This invention relates to irrigation sprinkler devices of the socalled rotary arm type.

These sprinklers comprise an upwardly inclined propulsion tube which rotates on a practically vertical fixed feed column to cover a circular sector with the water jet delivered by it.

The propulsion tube rotates by the action of an upper rotary arm which is swing-rotatable on a pin substantially orthogonal to the propulsion tube and carries at its front end at least one deflector device which interferes with the water jet. The water jet urges the arm to rotate away from its position substantially parallel to the propulsion tube, while elastic means return the arm into this position against a fixed stop where it is struck by the jet with a force which is sufficient to drag the entire propulsion tube by inertia, so that it rotates through a certain distance.

The rotations of the propulsions tube induced in this manner are the main or outward rotations.

If rotations are required in both directions, i.e. return rotations are also required, the arm is made able to swing symmetrically about the propulsion tube by modifying only the position of the fixed stop on one or the other side of the arm.

In this case the speed of the outward and return rotations are the same.

If the return speed is required to be different from, and generally greater than, the outward speed it is necessary in the known art to use at least two deflector devices, of which at least one is fixed.

In this case while the at least one fixed deflector damps the thrust of the arm during its outward rotation, it accelerates the thrust of the arm during its return rotation, so inducing a return speed greater than the outward speed.

In the case of currently known constructions, this type of irrigation spinkler operates perfectly for smaller diameter models.

In contrast, when the delivered water throughput increases above a certain level, the delivery nozzle of the propulsion tube acts too violently against the rotary arm deflector means, to irreparably compromise the proper regular operation of the sprinkler.

This drawback is overcome in the known art by positioning parallel to the propulsion tube a secondary nozzle the purpose of which is merely to operate the rotary arm.

In addition to the danger of the secondary nozzle clogging, this method results in a substantial reduction in the throw of the main jet, and operates properly only over a very small delivery pressure range, outside which the sprinkler operation is very irregular and entirely unsatisfactory.

The object of the present invention is to provide a rotary-arm irrigation sprinkler which is operated by the main sprinkler jet, is self-adjusting in order to ensure correct operation independent of throughput, and thus independent of the diameter of the nozzle fitted to the end of the propulsion tube and of the operating pressure, and can be further adjusted to vary the operating speed of the jet in order to adapt it to the nature of the terrain.

This object is attained by applying between the pin about which the rotary arm rotates and the rotary arm itself an intermediate piece which is adjustable both in height and in inclination, to in its turn adjust the height of the rotary arm.

The position of said intermediate piece can be defined both by virtue of its bearing on the nozzle applied to the propulsion tube, and also by virtue of its engagement with adjustable support means operable from the outside, so that it can be positioned in height according to the diameter of the nozzle, and for one and the same nozzle can also be slightly swivelled in the vertical plane.

The rotary arm assumes the same height position as the intermediate piece, so that that part of the deflector means which interferes with the jet is always the desired part.

In addition, according to the invention whereas during the outward stroke the arm rotates freely in one direction but is restrained by a stop in the opposite direction, during the return stroke it rotates between two stops located a fixed distance apart and forming part of a single component.

Furthermore, according to the invention the deflector comprises fins substantially parallel to the water flow, to give the deflector a slight downward thrust to keep it immersed in the jet and thus prevent annoying vibration of the arm.

The merits and constructional and operational advantages of the invention will be more apparent from the detailed description of a preferred embodiment thereof given hereinafter by way of nonlimiting example with reference to the accompanying drawings.

Figure 1:
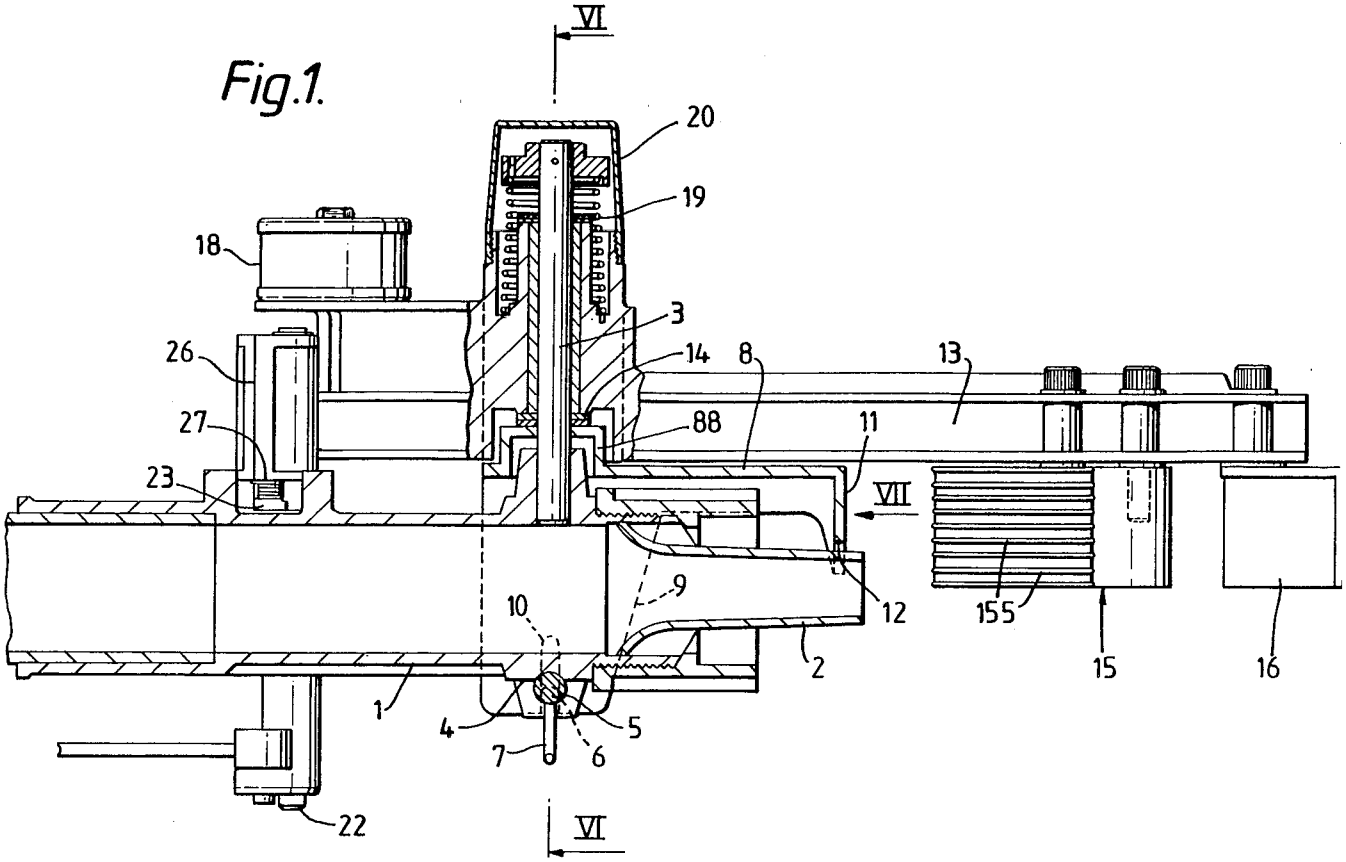
FIG. 1 is a partly sectional view of the end part of a self-adjusting irrigation sprinkler according to the invention.
Figure 6:
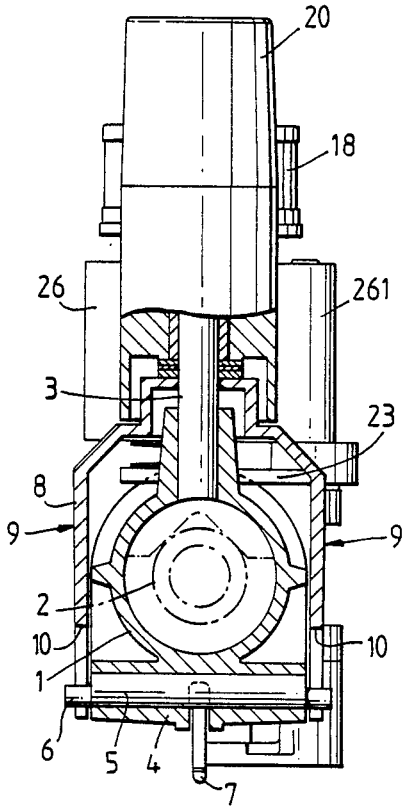
FIG. 6 is a section on the line VI-VI of FIG. 1.
Figure 7:
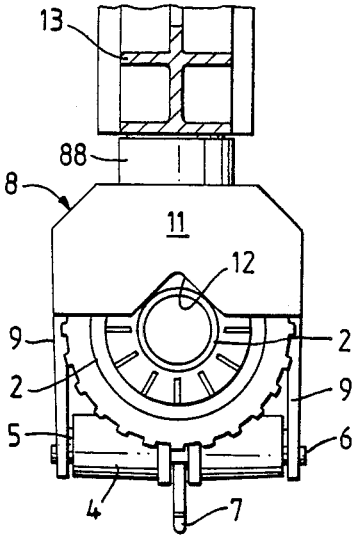
FIG. 7 is a view in the direction VII of FIG. 1.

FIGS. 1 and 6 show the end part of a propulsion tube 1 to which a delivery nozzle 2 is applied.

Immediately upstream of the delivery nozzle the tube 1 is provided upperly with a vertical pin 3, whereas in its underlying region (see FIG. 6) it comprises a transverse sleeve 4 in which there is rotatably inserted a pin 5 provided at its projecting ends with two cams 6. The pin 5 can rotate under the control of a lever 7. On the pin 3 there is mounted an intermediate piece 8 which can slide vertically and rotate slightly about the pin 3. The piece 8 comprises two side walls 9 which descend about the sides of the tube 1 and are provided with two vertical opposing slots 10. The piece 8 terminates frontally with a vertical wall 11 provided at its centre with an inverted V-shaped seat 12. When mounted on its pin 3, the piece 8 assumes the position determined by the seat 12 bearing on the outer edge of the nozzle 2 and by the engagement of the cams 6 in the slots 10. The diameter of the nozzle 2 thus determines the height position of the piece 8, whereas the position of the cams 6, determined by the lever 7, sets the inclination of the piece 8 to the propulsion tube.

Above the intermediate piece 8 there is mounted on the pin 3 the rotary arm 13, which rests on a projection 88 from the piece 8 by way of two antifriction washers 14. The arm 13 carries at its front a rotary deflector 15 and a fixed deflector 16, which are not described as they are of usual type, other than to note that the deflector 15 comprises parallel external fins 155 the purpose of which is described hereinafter.

At its rear end the arm 13 carries a stop finger 17 and a counterweight 18. A torsion spring 19 extending between the pin 3 and arm 13 elastically maintains this latter in the position A of FIG. 2, the spring 19 being adjustable and covered by a cap 20. In the region to the rear of the pin 3 the propulsion tube 1 comprises (see FIG. 5) two lateral lugs 21 through which is inserted the shaft 22 associated with the means, not shown as of usual type, which control the reversal of movement of the sprinkler. The shaft 22 has fixed to it, in the region above the tube 1 a lever 23 which can assume two positions (see FIG. 4) against two fixed upper stops 24 and 25 rigid with the tube 1.

Figure 2:
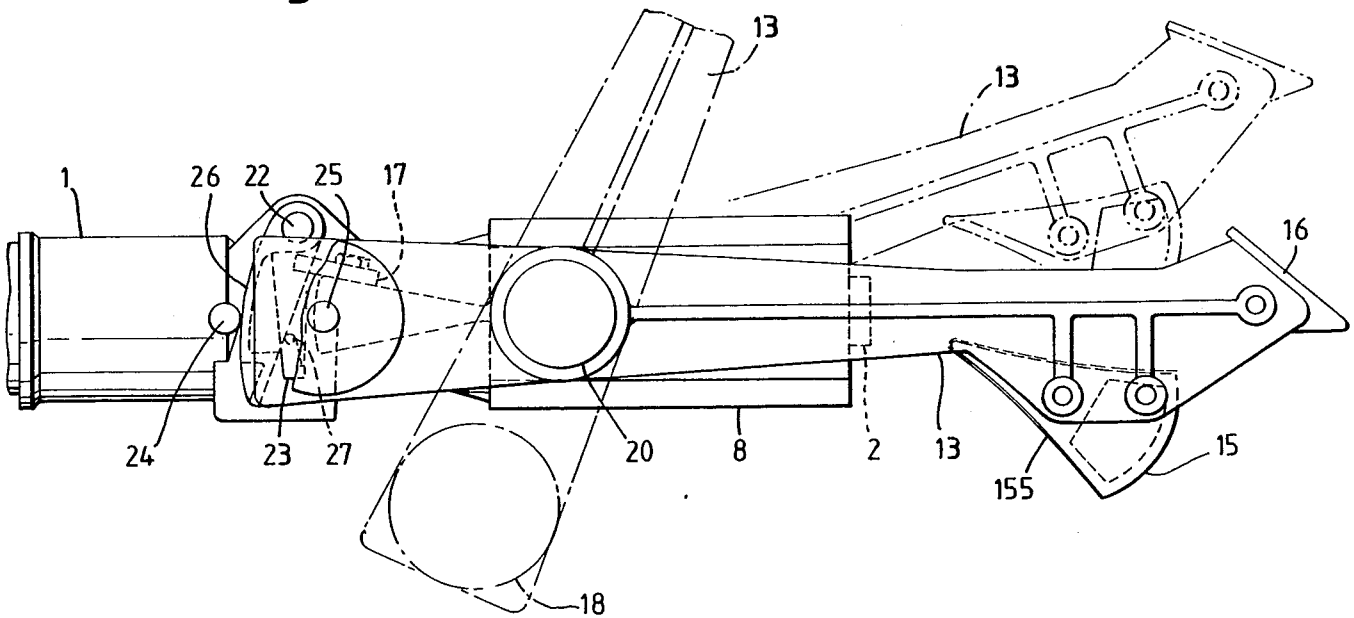
FIG. 2 is a plan view of that shown in FIG. 1.
Figure 3:
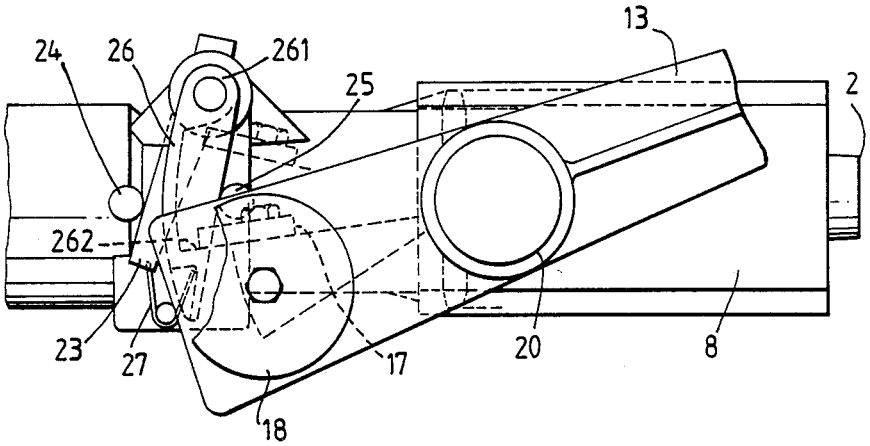
FIG. 3 is a partial view of that shown in FIG. 2.
Figure 4:
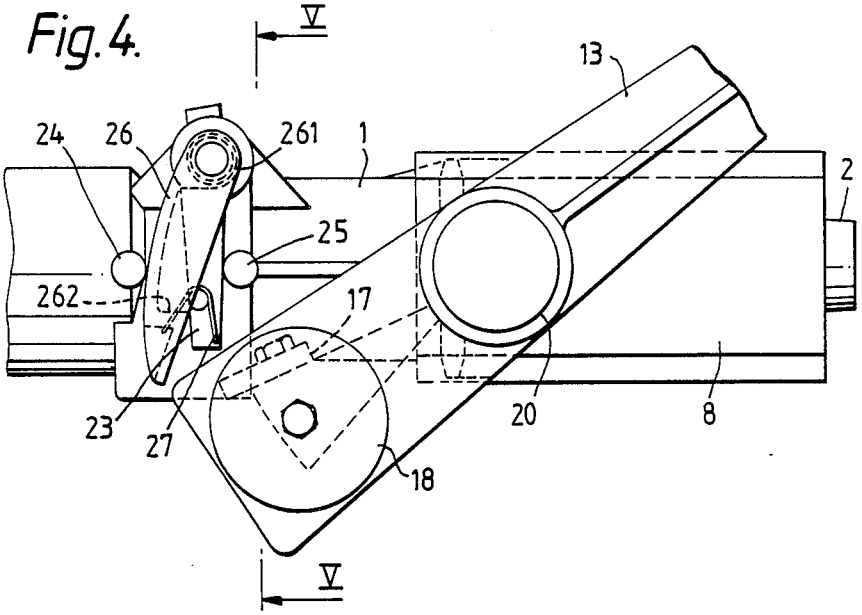
FIG. 4 is a partial view of that shown in FIG. 3 but in a different operating position.
Figure 5:
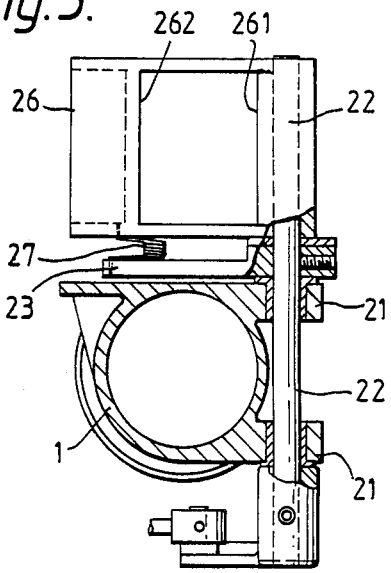
FIG. 5 is a section on the line V-V of FIG. 4.

On the upper part of the shaft there is mounted in a freely rotatable manner a shaped blade 26, the sectional shape of which can be seen in FIGS. 2, 3 and 4 and which comprises a hub 261 and a step 262.

The blade 26 is connected to the lever 23 by an off-centre spring 27 which causes it to undergo rotation in the opposite direction to the rotations of the lever 23 which are always delimited by the fixed upper stops 24 and 25. The device operates as follows.

When a nozzle 2 of the required diameter has been fitted to the propulsion tube 1, the intermediate piece 8 assumes a position in terms of height which ensures that the deflectors 15 and 16 are suitably immersed in the delivered water jet. This thus ensures that the thrust which rotates the arm 13 away from the jet is balanced to thus determine acceptable amplitudes of arm swing. A finer adjustment of the extent of immersion of the deflector in the jet can be obtained by operating the lever 7, i.e. by varying the inclination of the intermediate piece 8 and thus the height of the arm 13. This type of adjustment enables the deflector immersion to be adjusted in accordance with the jet delivery pressure for any nozzle diameter. During the main or outward stroke the blade 26 is in the position shown in FIG. 4.

The finger fixed to the rear of the arm 13 thus halts against the hub 261 of the blade 26, and the arm rotates freely in the other direction. The amplitude and frequency of the swing movements determine the speed of rotation of the sprinkler. It should be added that these two parameters depend on the extent of immersion of the deflector in the jet and one the tension of the return spring. During the return stroke the blade 26 is rotated into the position shown in FIGS. 2 and 3, and the finger 17 is constrained to rotate between the hub 261 and the step 262 of the blade 26.

In both cases the fins 155 of the deflector 15 are always orientated in the sense of drawing the deflector towards the jet, i.e. downwards, so eliminating any undesirable vibration of the rotary arm. It should also be noted that the embodiment shown is particularly simple and economical, but can be subjected to numerous modifications. For example the intermediate piece 8 could be a separate plate independently adjustable in height and inclination, and itself carrying the pin on which the rotary arm rotates. Thus the illustrated embodiment is non-limiting and numerous modifications and improvements can be made to the practical implementation of the invention but without leaving the scope of protection of the following claims.

I claim:

1. A self-adjusting rotary-arm irrigation sprinkler comprising:

a propulsion tube for emitting a water jet;

a rotary arm for undergoing swing rotation being mounted on a support pin about which said rotary arm rotates projecting from said propulsion tube, said rotary arm having at least one deflector mounted on a front portion thereof which interferes with said water jet, and said rotary arm being biased against elastic means disposed on said support pin which urges said rotary arm towards a position overlying said propulsion tube;

mobile arresting means mounted on said propulsion tube adjacent to said rear portion of said rotary arm for arresting the rotation of said rotary arm; and an intermediate member disposed between said propulsion tube and said rotary arm, which supports said rotary arm, said intermediate member including an adjusting means for adjusting both height and inclination of said rotary arm relative to said propulsion tube.

2. A sprinkler as claimed in claim 1, further comprising a nozzle disposed on the end of said propulsion tube, wherein said intermediate member comprises a plate provided with two descending side walls and a frontal wall, said side walls being provided with vertical opposing slots, said frontal wall being provided with an inverted V-shaped seat, there being provided at the centre of the plate a projection with a central hole through which said support pin projecting from the spinkler propulsion tube is slidably inserted, said side slots receiving eccentric end pins of an adjustable shaft, wherein the angular position of said adjustable shaft is adjusted by means of an appendix attached thereto which is fixed transversely under said propulsion tube, said V-shaped seat resting on the upper edge of said nozzle.

3. A sprinkler as claimed in claims 1 or 2, wherein said rotary arm rests on said intermediate member by way of antifriction washers and said rotary arm is mounted on said support pin which is mounted directly on the projects from said propulsion tube through said intermediate member.

4. A sprinkler as claimed in claim 1, wherein said rotary arm is mounted on said support pin which is mounted directly on and projects from said intermediate member.

5. A sprinkler as claimed in claim 1, wherein said deflector disposed at the front portion of said rotary arm comprises parallel ribs arranged to urge it into said water jet delivered by said propulsion tube.

6. A sprinkler as claimed in claim 1, wherein said mobile arresting means comprises an arresting blade provided with first and second opposing stop surfaces and is rotatable between two positions in order to form a unilateral stop for the outward rotary stroke of said rotary arm, and a bilateral stop for the return rotary stroke thereof.

7. A sprinkler as claimed in claim 2, wherein said deflector disposed at the front portion of said rotary arm comprises parallel ribs arranged to urge it into said water jet delivered by said propulsion tube.

8. A sprinkler as claimed in claim 7, wherein said mobile arresting means comprises an arresting blade provided with first and second opposing stop surface and rotatable between two positions in order to form a unilateral stop for the outward rotary stroke of said rotary arm, and a bilateral stop for the return rotary stroke thereof.

9. A sprinkler as claimed in claim 7, wherein said arresting blade is rotatably disposed on a blade shaft and said rear portion of said rotary arm includes a stop arm member for engaging said first and second stop surfaces of said arresting blade, wherein said stop arm member engages said first stop surface so as to form said unilateral stop for the outward rotary stroke and said stop arm member engages both said stop surfaces so as to form a bilateral stop for the return rotary stroke of said rotary arm.

10. A sprinkler as claimed in claim 1, wherein said rotary arm further comprises a counterweight mounted on said rear portion thereof above said mobile arresting means and first and second deflectors mounted on a front portion thereof, wherein said first deflector comprises a fixed deflector mounted on the front end of said rotary arm and said second deflector comprises a rotary deflector mounted adjacent to said first deflector for eliminating undesirable vibration of said rotary arm.

11. A sprinkler as claimed in claim 1, wherein said intermediate member comprises a support structure which fits over said propulsion tube with a central hole through which said support pin is slidably inserted, and an adjustable member disposed under said propulsion tube and operatively connected to said support structure, wherein adjustment of said adjustable member causes said rotary arm to change in position with regard to height and inclination relative to said propulsion tube.

12. A sprinkler as claimed in claim 5, wherein said intermediate member comprises a support structure which fits over said propulsion tube with a central hole through which said support pin is slidably inserted, and an adjustable member disposed under said propulsion tube and operativley connected to said support structure, wherein adjustment of said adjustable member causes said rotary arm to change in position with regard to height and inclination relative to said propulsion tube.

* * * * *